US012709889B2

(12) United States Patent
Huang et al.

(10) Patent No.: US 12,709,889 B2
(45) Date of Patent: Aug. 18, 2026

(54) FREE-EXPANSION DEFORMATION SEAM STRUCTURE APPLIED TO FLOOR

(71) Applicant: CHINA CONSTRUCTION SCIENCE AND INDUSTRY CORPORATION LTD., Shenzhen (CN)

(72) Inventors: Minghua Huang, Shenzhen (CN); Huihong Gu, Shenzhen (CN); Dongliang Zhang, Shenzhen (CN); Zongzhao Chen, Shenzhen (CN); Mingzhi Chen, Shenzhen (CN); Guangning Yang, Shenzhen (CN)

(73) Assignee: CHINA CONSTRUCTION SCIENCE AND INDUSTRY CORPORATION LTD., Shenzhen (CN)

( * ) Notice: Subject to any disclaimer, the term of this patent is extended or adjusted under 35 U.S.C. 154(b) by 377 days.

(21) Appl. No.: 18/237,577

(22) Filed: Aug. 24, 2023

(65) Prior Publication Data

US 2024/0240452 A1 Jul. 18, 2024

(30) Foreign Application Priority Data

Jan. 16, 2023 (CN) ..... 202310085890.X

(51) Int. Cl.
*E04B 1/68* (2006.01)
*E04B 1/00* (2006.01)

(52) U.S. Cl.
CPC ..... *E04B 1/6804* (2013.01)

(58) Field of Classification Search
CPC .... E04B 1/6804; E04B 1/6803; E04B 1/6807; E04B 1/6812; E04B 1/6815
USPC ..... 52/696.04
See application file for complete search history.

(56) References Cited

U.S. PATENT DOCUMENTS 3,018,703 A * 1/1962 Fujihara ..... E04B 1/6804 404/69
3,068,763 A * 12/1962 Harza ..... E01C 11/126 404/67
3,183,626 A * 5/1965 Schmitt ..... E04B 1/6815 52/459

(Continued)

FOREIGN PATENT DOCUMENTS

DE 19646811 C1 * 2/1998 ..... E01D 19/06
EP 0382681 A1 * 8/1990 ..... E01D 19/065

(Continued)

*Primary Examiner* — Brian D Mattei
*Assistant Examiner* — Joseph J. Sadlon
(74) *Attorney, Agent, or Firm* — Maschoff Brennan

(57) ABSTRACT

A free-expansion deformation seam structure applied to a floor, including: a first base, a second base, a cover plate, a first telescopic component and a second telescopic component. A bottom of the cover plate is provided with a first connection part and a second connection part, one end of the first telescopic component is clamped in the first clamping groove in the first base, the other end thereof is fixedly connected to the first connection part, one end of the second telescopic component is clamped in the second clamping groove in the second base, the other end thereof is fixedly connected to the second connection part, and the first telescopic component and the second telescopic component are capable of expanding and contracting in the horizontal direction of the expansion seam to drive the cover plate to slide on the first base and the second base.

9 Claims, 3 Drawing Sheets

(56) References Cited

U.S. PATENT DOCUMENTS 3,371,456 A * 3/1968 Balzer ..... E04B 1/6804 404/69
3,417,528 A * 12/1968 Hallock ..... E04B 1/6804 52/367
3,659,390 A * 5/1972 Balzer ..... E04B 1/6804 404/69
3,662,506 A * 5/1972 Dillon ..... E04B 5/38 52/262
3,696,575 A * 10/1972 Armstrong ..... E04B 1/6804 52/395
3,750,359 A * 8/1973 Balzer ..... E04B 1/681 52/468
3,779,660 A * 12/1973 McGeary ..... F16L 25/0027 404/69
3,864,886 A * 2/1975 Thom ..... E04B 1/6804 52/396.04
3,880,539 A * 4/1975 Brown ..... E01D 19/06 14/73.1
3,906,694 A * 9/1975 Schubach ..... E04B 5/023 52/471
4,073,673 A * 2/1978 Raabe ..... B29C 48/12 264/177.17
4,131,405 A * 12/1978 Moore ..... B28B 7/02 249/165
4,586,299 A * 5/1986 Bayer ..... E04B 1/348 52/79.7
4,649,129 A * 3/1987 Dunsworth ..... E04B 1/68 502/407
4,829,726 A * 5/1989 de Potter d'Indoye ..... E04B 1/3444 52/64
4,914,884 A * 4/1990 Ohmatsu ..... E04B 1/6815 404/47
H982 H * 11/1991 Berggren ..... E04D 7/00 427/362
5,067,297 A * 11/1991 Sobol ..... E04B 1/6815 52/396.05
5,318,758 A * 6/1994 Fujii ..... B01D 53/1406 423/229
5,400,559 A * 3/1995 Nicholas ..... E01D 19/06 404/55
5,584,152 A * 12/1996 Baerveldt ..... B29C 48/11 404/69
5,667,192 A * 9/1997 Van Doren ..... B28B 7/06 249/82
5,887,400 A * 3/1999 Bratek ..... E04B 1/681 52/573.1
6,430,884 B1 * 8/2002 Shreiner ..... E04B 1/681 52/460
6,527,467 B2 * 3/2003 Betts ..... E01D 19/065 52/393
6,581,347 B1 * 6/2003 Knak ..... E04F 15/02005 52/471
6,854,737 B2 * 2/2005 Fieger ..... E01D 19/06 277/630
7,354,219 B2 * 4/2008 Leonberg ..... E01D 19/06 404/58
7,560,646 B2 * 7/2009 Heffner ..... H01B 13/143 174/113 AS
7,827,750 B2 * 11/2010 Sondermann ..... E04B 1/681 52/396.04
8,079,191 B2 * 12/2011 Martin ..... E04D 5/148 52/409
8,146,313 B2 * 4/2012 Proot ..... B26B 29/06 52/716.2
8,365,473 B2 * 2/2013 Bjerre ..... E04C 2/288 52/79.14
8,869,482 B2 * 10/2014 Hunke ..... E04B 5/00 52/395
8,893,448 B2 * 11/2014 Wierzbowski ..... E04B 1/6803 52/6
10,053,857 B1 * 8/2018 Gebhardt ..... E04B 1/681
10,260,230 B2 * 4/2019 Rogers ..... E04C 5/12
10,352,004 B2 * 7/2019 Lourenço ..... E01C 5/005
10,358,814 B2 * 7/2019 Maziarz ..... E04B 1/6809
10,385,564 B2 * 8/2019 Fisher ..... E04B 1/6807
10,486,330 B2 * 11/2019 Giles ..... B28B 3/20
10,858,826 B2 * 12/2020 Gebhardt ..... E04B 1/388
10,968,578 B2 * 4/2021 Veneri ..... E01C 11/005
10,968,636 B2 * 4/2021 Charles ..... E04F 11/022
11,414,856 B2 * 8/2022 Wu ..... E04B 1/6812
12,146,316 B2 * 11/2024 Devlin ..... E01C 11/08
12,297,652 B2 * 5/2025 Claro Carrascal .... E04G 17/042
2003/0024172 A1 * 2/2003 Lyons ..... A62C 3/16 52/267
2008/0127590 A1 * 6/2008 Derrigan ..... E02D 17/10 52/395
2010/0024323 A1 * 2/2010 Huang ..... E04B 1/24 52/745.05
2011/0061336 A1 * 3/2011 Thomas ..... E04B 1/10 52/745.19
2024/0183149 A1 * 6/2024 Owens ..... E04B 1/681

FOREIGN PATENT DOCUMENTS

EP 3369870 A1 * 9/2018 ..... E04B 1/6804
FR 3002243 A1 * 8/2014 ..... E01D 19/06
GB 1214310 A * 12/1970 ..... E04B 1/6804
KR 19980072523 A * 11/1998 ..... E01D 19/06
KR 200198768 Y1 * 10/2000 ..... E01D 19/06
KR 20050051999 A * 6/2005 ..... E01D 19/06
KR 20070044424 A * 4/2007 ..... E01D 19/065
KR 20070121382 A * 12/2007 ..... E04B 1/6801
KR 100950793 B1 * 4/2010 ..... E01C 11/10
KR 101203480 B1 * 11/2012 ..... E03F 5/14

* cited by examiner

FREE-EXPANSION DEFORMATION SEAM STRUCTURE APPLIED TO FLOOR

TECHNICAL FIELD

The present disclosure relates to the technical field of building construction, in particular to a free-expansion deformation seam structure applied to a floor.

BACKGROUND

In addition to relative displacement caused by expansion caused by heat and contraction caused by cold due to temperature change, a building may also produce relative displacement due to external forces such as land subsidence, inclination, and earthquake. In order to protect the building from damage due to relative displacements, extension seams are usually reserved in a floor, a wall, a suspended ceiling, etc. of the building. In order to be beautiful, it is often necessary to cover the expansion seams. People usually call a facility covering the expansion seams a deformation seam. The deformation seam divides a concrete structure into several units, and needs to be sealed by relevant practices in order to meet the requirements of beauty, applicability and safety.

The concrete structure includes a floor slab and a surface course, and the conventional deformation seam is composed of three parts of bases on both sides, and a cover plate at the middle, the bases on both sides each are open, and are arranged parallel to the length direction of the deformation seam, the bases are fixed to the floor slab as a whole by means of expansion bolts, and then the cover plate at the middle is penetrated from one side to be completely clamped into clamping grooves of the bases. Under the action of external forces such as temperature and earthquake, the cover plate undergoes displacement deformation in the clamping grooves, and is reset.

In the conventional deformation seam, the cover plate is freely deformed in the clamping grooves of the bases, and the tops of the bases are prone to deformation due to long-term loads such as person walking and object carrying, and when the surface wear is severe, the bases need to be replaced. Replacement of the bases requires removal of the cover plate at the middle and removal of the original expansion bolts, and thus repair and disassembly are complicated. And both sides of the bases are higher than the cover plate, stains are easily accumulated on the cover plate during long-term use, and sewage accumulates and is difficult to clean when a floor is mopped.

SUMMARY

Therefore, the technical problem to be solved by the present disclosure is to overcome the defects in the prior art that the surfaces of bases of a deformation seam are severely worn, and repair and disassembly are complicated, thereby providing a free-expansion deformation seam structure applied to a floor.

To solve the above technical problem, the technical solutions of the present disclosure are as follows:

a free-expansion deformation seam structure applied to a floor includes: a first base, a second base, a cover plate, a first telescopic component and a second telescopic component, wherein the first base and the second base are fixedly installed on floor slabs on both sides of an expansion seam respectively, the first base is provided with a first clamping groove, and the second base is provided with a second clamping groove; the cover plate covers the first base and the second base, and a bottom of the cover plate is fixedly connected with a first connection part and a second connection part; one end of the first telescopic component is clamped in the first clamping groove, and the other end thereof is fixedly connected to the first connection part; one end of the second telescopic component is clamped in the second clamping groove, the other end of the second telescopic component is fixedly connected to the second connection part; and the first telescopic component and the second telescopic component are capable of expanding and contracting in a reciprocating mode in a horizontal direction of the expansion seam to drive the cover plate to slide on the first base and the second base.

According to some embodiments of the present disclosure, the first telescopic component includes a first elastic member and first clamping plates arranged at both ends of the first elastic member, one of the first clamping plates is clamped in the first clamping groove, and the other of the first clamping plates is fixedly connected to the first connection part; and the second telescopic component includes a second elastic member and the second clamping plates arranged at both ends of the second elastic member, one of the second clamping plates is clamped in the second clamping groove, and the other of the second clamping plates is fixedly connected to the second connection part.

According to some embodiments of the present disclosure, both the first elastic member and the second elastic member are springs, both ends of the first elastic member are respectively welded to the first clamping plates, and both ends of the second elastic member are respectively welded to the second clamping plates.

According to some embodiments of the present disclosure, both the first connection part and the second connection part are angle steels, the first connection part is fixed to one of the first clamping plates in a welding mode, and the second connection part is fixed to one of the second clamping plates in a welding mode.

According to some embodiments of the present disclosure, the first base includes a first fixing plate, a first abutting plate, and a first connection plate configured to connect the first fixing plate with the first abutting plate, the first connection plate is provided with a first extension part extending in the horizontal direction of the expansion seam, and the first clamping groove is arranged at one end of the first extension part away from the first connection plate;

the second base includes a second fixing plate, a second abutting plate, and a second connection plate configured to connect the second fixing plate with the second abutting plate, the second connection plate is provided with a second extension part extending in the horizontal direction of the expansion seam, and the second clamping groove is arranged at one end of the second extension part away from the second connection plate; and the first fixing plate and the second fixing plate are fixedly installed on the floor slabs on both sides of the expansion seam respectively, and the first abutting plate and the second abutting plate are configured to abut against a lower surface of the cover plate.

According to some embodiments of the present disclosure, the first extension part is arranged on a middle of the first connection plate, the second extension part is located on a middle of the second connection plate, and the first extension part and the second extension part are located on a same horizontal line.

According to some embodiments of the present disclosure, openings of the first clamping groove and the second clamping groove are oriented upwards, and groove depths of the first clamping groove and the second clamping groove are set in a vertical direction of the expansion seam.

According to some embodiments of the present disclosure, the free-expansion deformation seam structure applied to a floor further includes a plurality of fasteners, wherein both the first fixing plate and the second fixing plate are fixedly connected to the floor slabs by the fasteners.

According to some embodiments of the present disclosure, the fasteners are expansion anchor bolts.

According to some embodiments of the present disclosure, the first base, the second base and the cover plate are all made of an alloy material.

The technical solutions of the present disclosure have the following advantages:

1. according to the free-expansion deformation seam structure applied to a floor provided by the present disclosure, the first base and the second base are installed on the floor slabs on both sides of the expansion seam respectively, the cover plate covers the first base and the second base, the bottom of the cover plate is provided with the first connection part and the second connection part, one end of the first telescopic component is clamped in the first clamping groove in the first base, the other end thereof is fixedly connected to the first connection part, one end of the second telescopic component is clamped in the second clamping groove in the second base, the other end thereof is fixedly connected to the second connection part, and the first telescopic component and the second telescopic component are capable of expanding and contracting in the horizontal direction of the expansion seam to drive the cover plate to slide on the first base and the second base, achieving the purpose of free expansion, so as to avoid adverse effects on a building structure caused by temperature change, uneven subsidence of a foundation and earthquake, etc. In addition, according to the free-expansion deformation seam structure applied to a floor, the cover plate covers the first base and the second base to reduce the degree of wear of the first base and the second base, and the cover plate is connected to the first base and the second base through the first telescopic component and the second telescopic component, so that the disassembly and assembly procedures can be simplified, and the construction efficiency can be improved.

2. According to the free-expansion deformation seam structure applied to a floor provided by the present disclosure, the first elastic member and the second elastic member, as displacement release members, are adapted to resist external forces to guarantee the durability and reliability of the free-expansion deformation seam structure applied to a floor.

3. According to the free-expansion deformation seam structure applied to a floor provided by the present disclosure, the first base, the second base and the cover plate are all made of the alloy material, the alloy material has high hardness and strong corrosion resistance, and through the first base, the second base and the cover plate made of the alloy material, the load bearing capacity of the free-expansion deformation seam structure applied to a floor can be improved, the service life can be prolonged, and the cost can be reduced.

BRIEF DESCRIPTION OF FIGURES

In order to illustrate more clearly the specific embodiments of the present disclosure or the technical solutions in the prior art, the drawings required for description of the specific embodiments or the prior art will be briefly described below. It will be apparent that the drawings in the following description are some embodiments of the present disclosure, and those of ordinary skill in the art can obtain other drawings based on these drawings without inventive steps.

Figure 1:
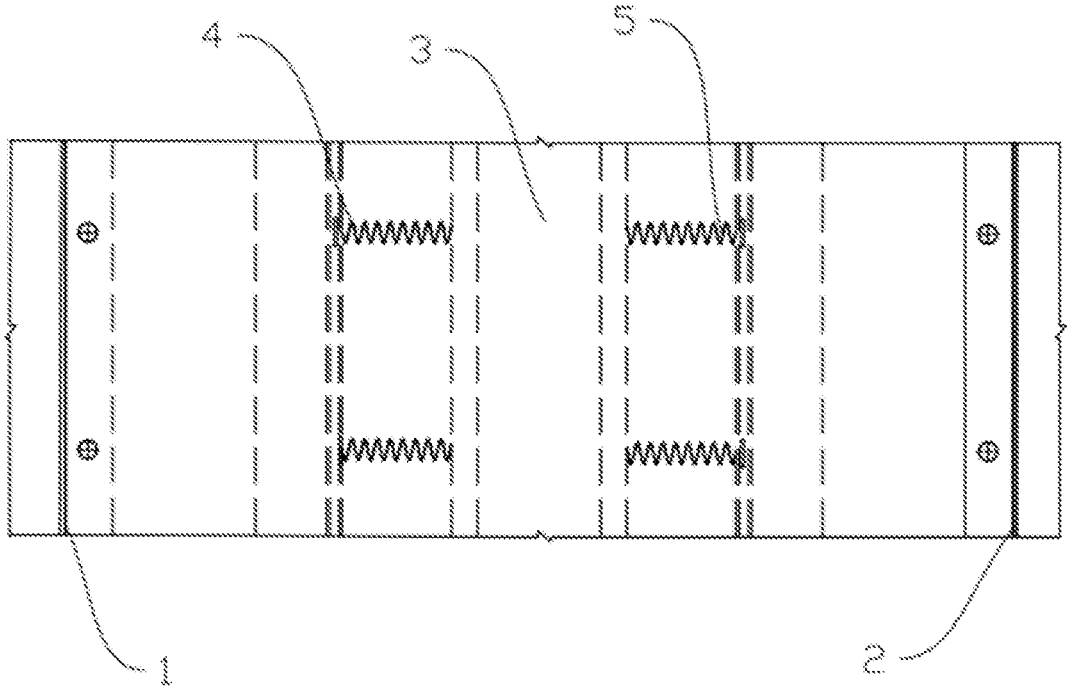
FIG. 1 is a schematic plan view of a free-expansion deformation seam structure applied to a floor provided in some embodiments of the present disclosure.

Description of reference signs: 1, first base; 2, second base; 3, cover plate; 4, first telescopic component; 5, second telescopic component; 6, fastener; 7, floor slab; 8, surface course; 11, first fixing plate; 12, first abutting plate; 13, first connection plate; 14, first extension part; 141, first clamping groove; 21, second fixing plate; 22, second abutting plate; 23, second connection plate; 24, second extension part; 241, second clamping groove; 31, first connection part; 32, second connection part; 41, first clamping plate; 42, first elastic member; 51, second clamping plate; and 52, second elastic member.

DETAILED DESCRIPTION

The technical solutions of the present disclosure will be clearly and fully described below in conjunction with the drawings, and obviously, the described embodiments are some, but not all, embodiments of the present disclosure. Based on the embodiments in the present disclosure, all other embodiments obtained by those of ordinary skill in the art without making inventive labor belong to the scope of protection of the present disclosure.

In the description of the present disclosure, it should be noted that the orientation or position relation indicated by terms "center", "upper", "lower", "left", "right", "vertical", "horizontal", "inner", "outer" and the like is based on the orientation or position relation shown in the drawings. The terms are only for describing the present disclosure and simplifying the description, rather than indicating or implying that the device or element referred to must have a specific orientation and be constructed and operated in a specific orientation, and therefore cannot be understood as a limitation of the present disclosure. Further, the terms "first", "second", and "third" are only for the descriptive purpose, but cannot understood as indicating or implying relative importance.

Throughout the description of the present disclosure, it should be noted that unless expressly specified and defined otherwise, the terms "installed", "connected" and "connection" should be broadly understood, for example, it can be fixed connection, detachable connection or integrated connection; it can be mechanical connection or electrical connection; and it can be direct connection or indirect connection through an intermediate medium, and may be internal communication of two elements. Those of ordinary skill in the art may understand the specific meaning of the above terms in the present disclosure according to specific situations.

Furthermore, technical features involved in different embodiments of the present disclosure described below can be combined with each other as long as they do not conflict with each other.

Referring to FIGS. 1 to 7, the present disclosure provides a free-expansion deformation seam structure applied to a floor, including: a first base 1, a second base 2, a cover plate 3, a first telescopic component 4 and a second telescopic component 5, wherein the first base 1 and the second base 2 are fixedly installed on floor slabs 7 on both sides of an expansion seam respectively, the first base 1 is provided with a first clamping groove 141, and the second base 2 is provided with a second clamping groove 241; the cover plate 3 covers the first base 1 and the second base 2, and a bottom of the cover plate 3 is fixedly connected with a first connection part 31 and a second connection part 32; one end of the first telescopic component 4 is clamped in the first clamping groove 141, and the other end thereof is fixedly connected to the first connection part 31; one end of the second telescopic component 5 is clamped in the second clamping groove 241, and the other end of the second telescopic component 5 is fixedly connected to the second connection part 32; and the first telescopic component 4 and the second telescopic component 5 are capable of expanding and contracting in a reciprocating mode in a horizontal direction of the expansion seam to drive the cover plate 3 to slide on the first base 1 and the second base 2.

Specifically, the first base 1 and the second base 2 are installed on the floor slabs 7 on both sides of the expansion seam respectively, the cover plate 3 covers the first base 1 and the second base 2, the bottom of the cover plate 3 is provided with the first connection part 31 and the second connection part 32, one end of the first telescopic component 4 is clamped in the first clamping groove 141 in the first base 1, the other end thereof is fixedly connected to the first connection part 31, one end of the second telescopic component 5 is clamped in the second clamping groove 241 in the second base 2, the other end thereof is fixedly connected to the second connection part 32, and the first telescopic component 4 and the second telescopic component 5 are capable of expanding and contracting in the horizontal direction of the expansion seam to drive the cover plate 3 to slide on the first base 1 and the second base 2, achieving the purpose of free expansion, so as to avoid adverse effects on a building structure caused by temperature change, uneven subsidence of a foundation and earthquake, etc.

In addition, the cover plate 3 covers the first base 1 and the second base 2, which is beneficial to reduce the degree of wear of the first base 1 and the second base 2, and the cover plate 3 is connected to the first base 1 and the second base 2 through the first telescopic component 4 and the second telescopic component 5, so that the disassembly and assembly procedures of the free-expansion deformation seam structure applied to a floor can be simplified, improving the construction efficiency.

It can be understood that the cover plate 3 covers the first base 1 and the second base 2, and an upper surface of the cover plate 3 is flush with an upper surface of the surface course 8, so that goods and materials can be prevented from being accumulated on the surface of the cover plate 3, the surface of the cover plate 3 can be easily cleaned, and the aesthetic requirements can be satisfied.

Figure 6:
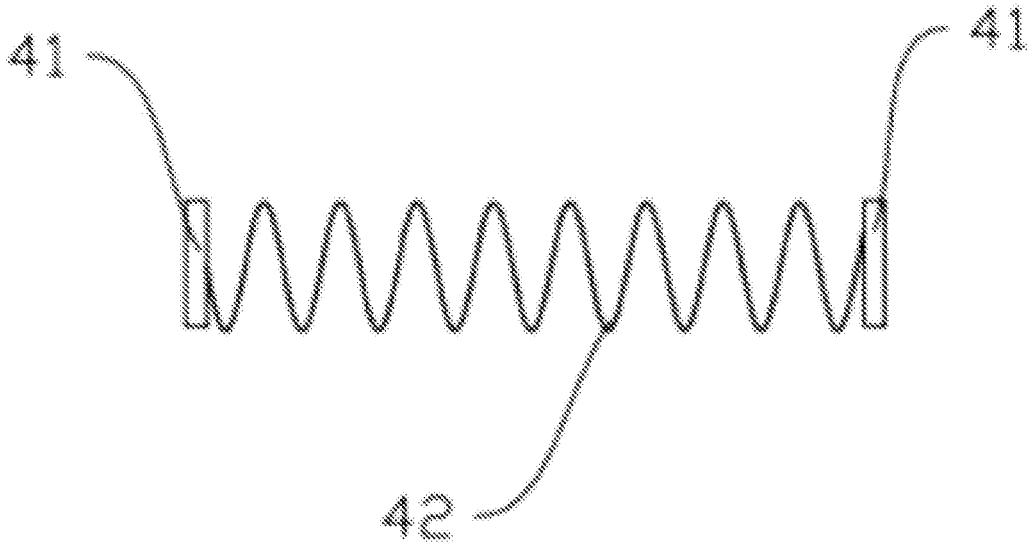
FIG. 6 is a schematic structural diagram of a first telescopic component according to some embodiments of the present disclosure.
Figure 7:
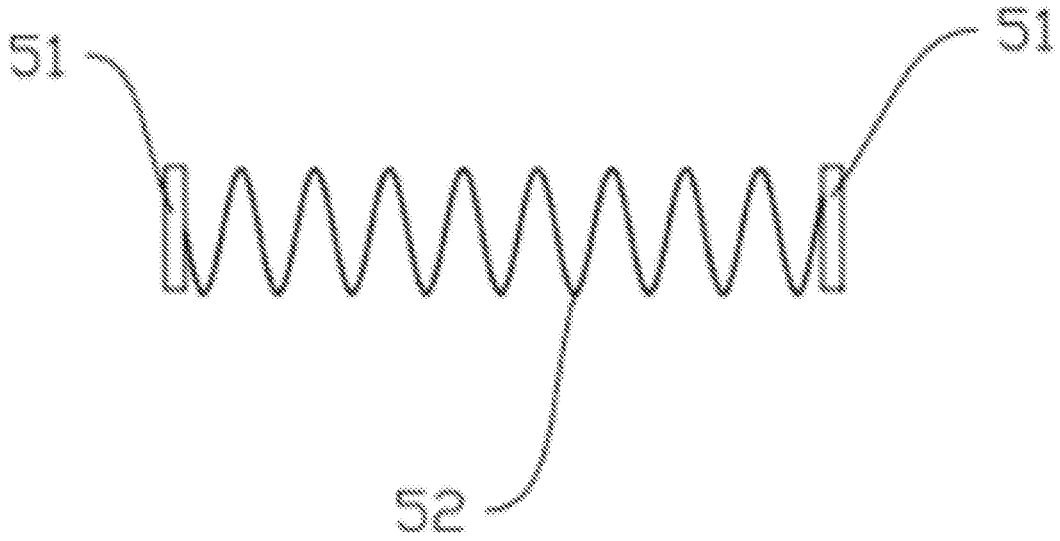
FIG. 7 is a schematic structural diagram of a second telescopic component according to some embodiments of the present disclosure.

Referring to FIGS. 6 and 7, in some embodiments of the present disclosure, the first telescopic component 4 includes a first elastic member 42 and first clamping plates 41 arranged at both ends of the first elastic member 42, one of the first clamping plates 41 is clamped in the first clamping groove 141, and the other of the first clamping plates 41 is fixedly connected to the first connection part 31; and the second telescopic component 5 includes a second elastic member 52 and second clamping plates 51 arranged at both ends of the second elastic member 52, one of the second clamping plates 51 is clamped in the second clamping groove 241, and the other of the second clamping plates 51 is fixedly connected to the second connection part 32.

In some embodiments of the present disclosure, both the first elastic member 42 and the second elastic member 52 are springs, both ends of the first elastic member 42 are respectively welded to the first clamping plates 41, and both ends of the second elastic member 52 are respectively welded to the second clamping plates 51.

Specifically, the first elastic member 42 and the second elastic member 52, as displacement release members, are adapted to resist external forces to guarantee the durability and reliability of the free-expansion deformation seam structure applied to a floor. By means of welding, the first connection part 31 and the second connection part 32 are fixedly connected with the first telescopic component 4 and the second telescopic component 5, so that the cover plate 3 is integrated with the first telescopic component 4 and the second telescopic component 5, facilitating disassembly and assembly, saving the time, improving the construction efficiency, and reducing the construction cost.

The first elastic member 42 and the second elastic member 52 are specifically springs, which are high-strength springs for resisting expansion deformation caused by external forces. The first clamping plates 41 are specifically made of a metal material to facilitate welding the first clamping plates 41 on both ends of the first elastic member 42, and similarly, the second clamping plates 51 are also made of a metal material. The specifications and dimensions of the first elastic member 42 and the second elastic member 52 are not intended to limit the present disclosure, and are specifically determined according to actual construction.

Figure 2:
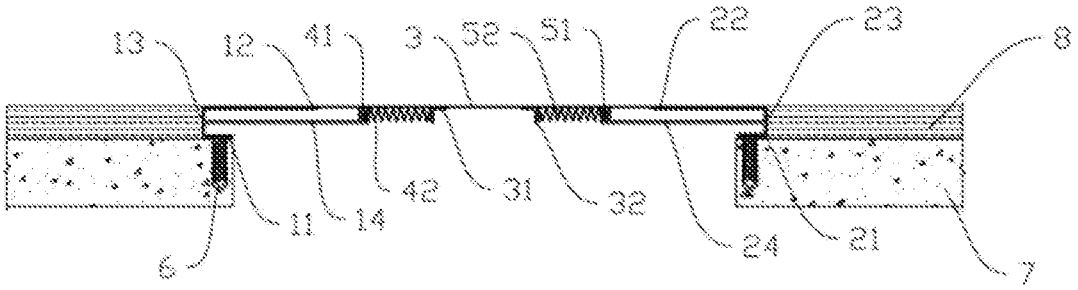
FIG. 2 is a schematic longitudinal cross-sectional view of a free-expansion deformation seam structure applied to a floor provided in some embodiments of the present disclosure.
Figure 5:
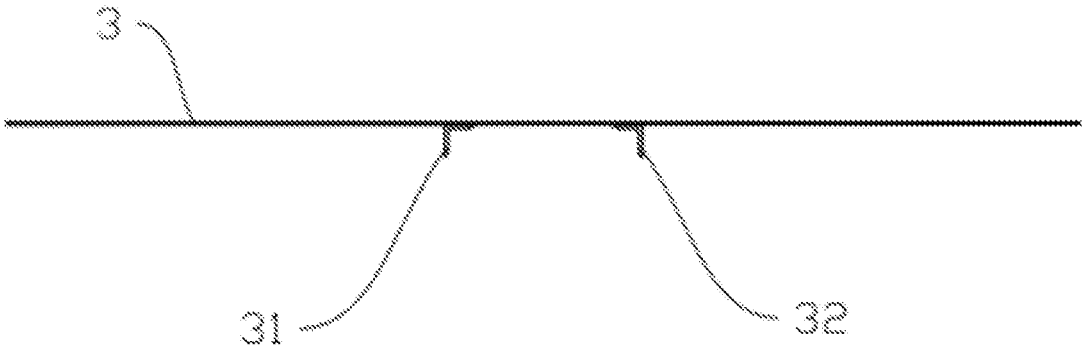
FIG. 5 is a schematic structural diagram of a cover plate according to some embodiments of the present disclosure.

Referring to FIGS. 2 and 5, in some embodiments of the present disclosure, both the first connection part 31 and the second connection part 32 are angle steels, the first connection part 31 is fixed to one of the first clamping plates 41 in a welding mode, and the second connection part 32 is fixed to one of the second clamping plates 51 in a welding mode.

Specifically, the first connection part 31 and the second connection part 32 are symmetrically disposed at the bottom of the cover plate 3, both the first connection part 31 and the second connection part 32 are made of a metal material, the specific structures of the first connection part 31 and the second connection part 32 are not intended to limit the present disclosure, and in the present disclosure, the first connection part 31 and the second connection part 32 are specifically angle steels.

Figure 3:
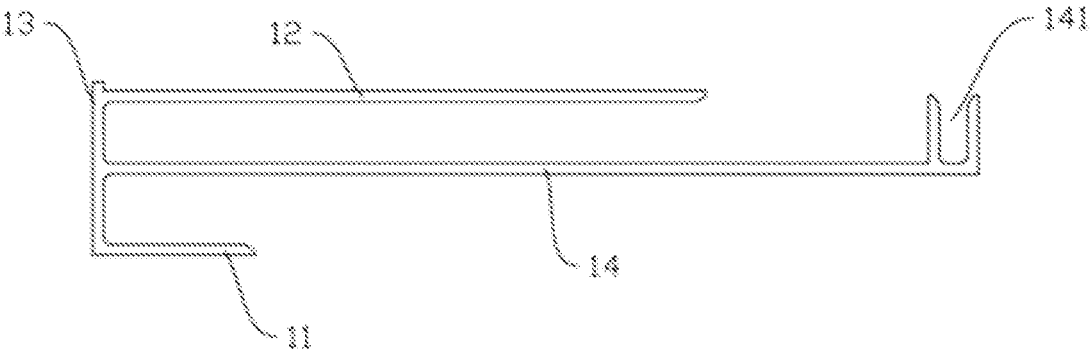
FIG. 3 is a schematic structural diagram of a first base according to some embodiments of the present disclosure.
Figure 4:
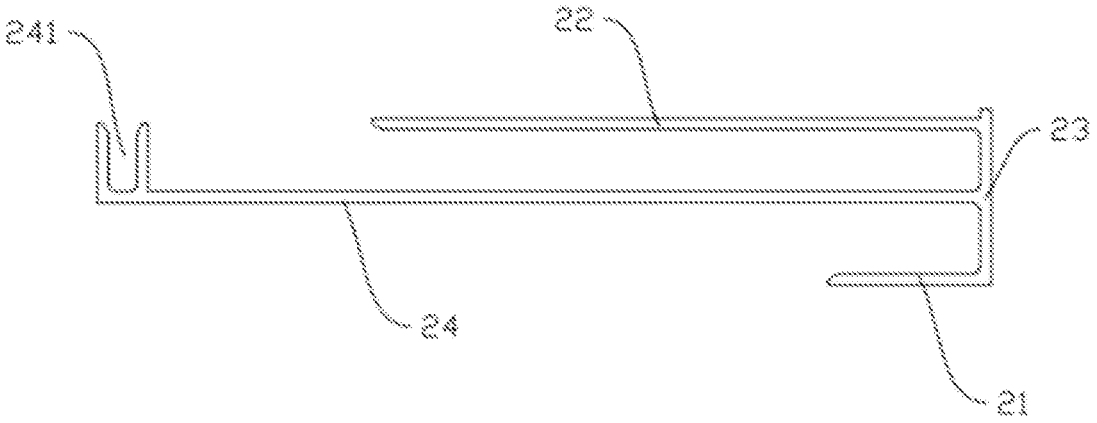
FIG. 4 is a schematic structural diagram of a second base according to some embodiments of the present disclosure.

Referring to FIGS. 3 and 4, in some embodiments of the present disclosure, the first base 1 includes a first fixing plate 11, a first abutting plate 12, and a first connection plate 13 configured to connect the first fixing plate 11 with the first abutting plate 12, the first connection plate 13 is provided with a first extension part 14 extending in the horizontal direction of the expansion seam, and the first clamping groove 141 is arranged at one end of the first extension part 14 away from the first connection plate 13;

the second base 2 includes a second fixing plate 21, a second abutting plate 22, and a second connection plate 23 configured to connect the second fixing plate 21 with the second abutting plate 22, the second connection plate 23 is provided with a second extension part 24 extending in the horizontal direction of the expansion seam, and the second clamping groove 241 is arranged at one end of the second extension part 24 away from the second connection plate 23; and the first fixing plate 11 and the second fixing plate 21 are fixedly installed on the floor slabs 7 on both sides of the expansion seam respectively, and the first abutting plate 12 and the second abutting plate 22 are configured to abut against a lower surface of the cover plate 3.

Specifically, the structures of the first base 1 and the second base 2 are consistent, the first base 1 and the second base 2 are fixedly installed on the floor slabs 7 on both sides of the expansion seam respectively, the cover plate 3 covers the first abutting plate 12 and the second abutting plate 22, the heights of the first connection plate 13 and the second connection plate 23 are consistent with the thickness of the surface course 8, the first connection plate 13, the second connection plate 23 and the surface course 8 are hermetically connected by a sealing material, playing a waterproof role, and the upper surface of the cover plate 3 is flush with the upper surface of the surface course 8, so as to avoid the accumulation of stains on the surface of the cover plate 3, and facilitate the cleaning of the cover plate 3.

Referring to FIGS. 2 to 4, in some embodiments of the present disclosure, the first extension part 14 is arranged on a middle of the first connection plate 13, the second extension part 24 is located on a middle of the second connection plate 23, and the first extension part 14 and the second extension part 24 are located on a same horizontal line.

Specifically, the first extension part 14 is located on the middle of the first connection plate 13, the second extension part 24 is located on the middle of the second connection plate 23, one end of the first extension part 14 away from the first connection plate 13 is clamped to one of the first clamping plates 41 of the first telescopic component 4, and the other of the first clamping plates 41 of the first telescopic component 4 is welded to the first connection part 31 disposed at the bottom of the cover plate 3; and one end of the second extension part 24 away from the second connection plate 23 is clamped to one of the second clamping plates 51 of the second telescopic component 5, and the other of the second clamping plates 51 of the second telescopic component 5 is welded to the second connection part 32 disposed at the bottom of the cover plate 3. When the cover plate 3 is subjected to a pressure load, the first extension part 14 and the second extension part 24 transmit the load to the first connection plate 13 and the second connection plate 23 and then to the concrete structure. The reliability of the free-expansion deformation seam structure applied to a floor is guaranteed.

It can be understood that the first extension part 14 is located on the middle of the first connection plate 13, and the second extension part 24 is located on the middle of the second connection plate 23, ensuring uniform force on the first connection plate 13 and the second connection plate 23, and improving the reliability.

In some embodiments of the present disclosure, openings of the first clamping groove 141 and the second clamping groove 241 are oriented upwards, and groove depths of the first clamping groove 141 and the second clamping groove 241 are set in a vertical direction of the expansion seam.

Specifically, since the cover plate 3 bears more downward pressure loads, the openings of the first clamping groove 141 and the second clamping groove 241 are oriented upward, facilitating the transmission of the pressure load, and improving the stability and reliability of the structure.

In some embodiments of the present disclosure, the free-expansion deformation seam structure applied to a floor further includes a plurality of fasteners 6, wherein both the first fixing plate 11 and the second fixing plate 21 are fixedly connected to the floor slabs 7 by the fasteners 6.

In some embodiments of the present disclosure, the fasteners 6 are expansion anchor bolts.

Specifically, in some embodiments of the present disclosure, the fasteners 6 are specifically configured as expansion anchor bolts, and the first fixing plate 11 and the second fixing plate 21 are fixedly installed on the floor slabs 7 on both sides of the expansion seam respectively by the expansion anchor bolts, and the specific size and specification of the fasteners 6 are not intended to limit the present disclosure, and can be determined according to the field construction environment and stress measurement.

In some embodiments according to the present disclosure, the first base 1, the second base 2 and the cover plate 3 are all made of an alloy material.

Specifically, the first base 1, the second base 2 and the cover plate 3 are all made of the alloy material, the alloy material has high hardness and strong corrosion resistance, and through the first base 1, the second base 2 and the cover plate 3 made of the alloy material, the load bearing capacity of the free-expansion deformation seam structure applied to a floor can be improved, the service life can be prolonged, and the cost can be reduce.

It can be understood that the first base 1, the second base 2 and the cover plate 3 are specifically manufactured by using an aluminum alloy material. The cover plate 3 made of aluminum alloy can withstand a pressure load and at the same time can serve as a decorative effect of an outside finish.

Obviously, the above embodiments are examples only for clear description, rather than limiting the embodiments. For those of ordinary skill in the art, other different forms of variations or changes can be made on the basis of the above description. It is unnecessary and impossible to enumerate all the embodiments here. Obvious variations or changes derived therefrom are still within the scope of protection of the present disclosure.

What is claimed is:

1. A free-expansion deformation seam structure applied to a floor, comprising:

a first base (1) and a second base (2), wherein the first base (1) and the second base (2) are fixedly installed on floor slabs (7) on both sides of an expansion seam respectively, the first base (1) is provided with a first clamping groove (141), and the second base (2) is provided with a second clamping groove (241);

a cover plate (3), covering the first base (1) and the second base (2), wherein a bottom of the cover plate (3) is fixedly connected with a first connection part (31) and a second connection part (32);

a first telescopic component (4), wherein one end of the first telescopic component (4) is clamped in the first clamping groove (141), and the other end thereof is fixedly connected to the first connection part (31); and a second telescopic component (5), wherein one end of the second telescopic component (5) is clamped in the second clamping groove (241), the other end of the second telescopic component (5) is fixedly connected to the second connection part (32), and the first telescopic component (4) and the second telescopic component (5) are capable of expanding and contracting in a reciprocating mode in a horizontal direction of the expansion seam to drive the cover plate (3) to slide on the first base (1) and the second base (2), wherein the first telescopic component (4) comprises a first elastic member (42) and first clamping plates (41) arranged at both ends of the first elastic member (42), one of the first clamping plates (41) is clamped in the first clamping groove (141), and the other of the first clamping plates (41) is fixedly connected to the first connection part (31); and the second telescopic component (5) comprises a second elastic member (52) and second clamping plates (51) arranged at both ends of the second elastic member (52), one of the second clamping plates (51) is clamped in the second clamping groove (241), and the other of the second clamping plates (51) is fixedly connected to the second connection part (32).

2. The free-expansion deformation seam structure applied to a floor of claim 1, wherein, both the first elastic member (42) and the second elastic member (52) are springs, both ends of the first elastic member (42) are respectively welded to the first clamping plates (41), and both ends of the second elastic member (52) are respectively welded to the second clamping plates (51).

3. The free-expansion deformation seam structure applied to a floor of claim 1, wherein, both the first connection part (31) and the second connection part (32) are angle steels, the first connection part (31) is fixed to one of the first clamping plates (41) in a welding mode, and the second connection part (32) is fixed to one of the second clamping plates (51) in a welding mode.

4. The free-expansion deformation seam structure applied to a floor of claim 1, wherein, the first base (1) comprises a first fixing plate (11), a first abutting plate (12), and a first connection plate (13) configured to connect the first fixing plate (11) with the first abutting plate (12), the first connection plate (13) is provided with a first extension part (14) extending in the horizontal direction of the expansion seam, and the first clamping groove (141) is arranged at one end of the first extension part (14) away from the first connection plate (13);

the second base (2) comprises a second fixing plate (21), a second abutting plate (22), and a second connection plate (23) configured to connect the second fixing plate (21) with the second abutting plate (22), the second connection plate (23) is provided with a second extension part (24) extending in the horizontal direction of the expansion seam, and the second clamping groove (241) is arranged at one end of the second extension part (24) away from the second connection plate (23); and the first fixing plate (11) and the second fixing plate (21) are fixedly installed on the floor slabs (7) on both sides of the expansion seam respectively, and the first abutting plate (12) and the second abutting plate (22) are configured to abut against a lower surface of the cover plate (3).

5. The free-expansion deformation seam structure applied to a floor of claim 4, wherein, the first extension part (14) is arranged on a middle of the first connection plate (13), the second extension part (24) is located on a middle of the second connection plate (23), and the first extension part (14) and the second extension part (24) are located on a same horizontal line.

6. The free-expansion deformation seam structure applied to a floor of claim 4, wherein, openings of the first clamping groove (141) and the second clamping groove (241) are oriented upwards, and groove depths of the first clamping groove (141) and the second clamping groove (241) are set in a vertical direction of the expansion seam.

7. The free-expansion deformation seam structure applied to a floor of claim 4, further comprising a plurality of fasteners (6), wherein both the first fixing plate (11) and the second fixing plate (21) are fixedly connected to the floor slabs (7) by the fasteners (6).

8. The free-expansion deformation seam structure applied to a floor of claim 7, wherein, the fasteners (6) are expansion anchor bolts.

9. The free-expansion deformation seam structure applied to a floor of claim 1, wherein, the first base (1), the second base (2) and the cover plate (3) are all made of an alloy material.

* * * * *